US006823802B2

(12) United States Patent
Butts, Jr.

(10) Patent No.: US 6,823,802 B2
(45) Date of Patent: Nov. 30, 2004

(54) PORTABLE EXPANDABLE PROJECT TABLE

(76) Inventor: Kenneth E. Butts, Jr., 638 Kimberly Way, Stevensville, MD (US) 21666

( * ) Notice: Subject to any disclaimer, the term of this patent is extended or adjusted under 35 U.S.C. 154(b) by 63 days.

(21) Appl. No.: 10/330,868

(22) Filed: Dec. 27, 2002

(65) Prior Publication Data

US 2004/0123780 A1 Jul. 1, 2004

(51) Int. Cl.[7] ..... A47B 85/00
(52) U.S. Cl. ..... 108/25; 108/144.11; 108/50.01
(58) Field of Search ..... 108/143, 137, 108/73, 74, 33, 34, 35, 36, 38, 152, 90, 69, 132, 131, 130, 144.11, 50.01, 25; 312/235.9, 290, 319.2, 327, 328

(56) References Cited

U.S. PATENT DOCUMENTS

| | | | | | |
|---|---|---|---|---|---|
| 830,532 | A | * | 9/1906 | Rozee | 108/11 |
| 1,211,829 | A | * | 1/1917 | Eades | 190/11 |
| D144,859 | S | * | 5/1946 | McKenzie | D6/425 |
| 3,156,510 | A | * | 11/1964 | Hindin et al. | 312/223.5 |
| 3,382,794 | A | * | 5/1968 | Lindholm et al. | 100/34 |
| 4,099,469 | A | | 7/1978 | Sahli | |
| 4,372,631 | A | | 2/1983 | Leon | |
| 4,383,721 | A | * | 5/1983 | Knaack et al. | 312/290 |
| 4,408,850 | A | | 10/1983 | Norek | |
| 5,088,421 | A | | 2/1992 | Beckstead | |
| 5,104,080 | A | * | 4/1992 | Berger | 248/250 |
| 5,315,935 | A | | 5/1994 | Weisenfels | |
| 5,598,789 | A | | 2/1997 | Jonker | |
| 6,142,140 | A | * | 11/2000 | Shumaker | 126/9 B |
| 6,289,824 | B1 | * | 9/2001 | Parker et al. | 108/115 |
| 6,494,419 | B2 | * | 12/2002 | Pai | 248/127 |

FOREIGN PATENT DOCUMENTS

EP 399098 * 10/1989

* cited by examiner

*Primary Examiner*—Jose V. Chen
(74) *Attorney, Agent, or Firm*—Lawrence E. Laubscher, Jr.

(57) ABSTRACT

A portable expandable project plan table includes a table top that is pivotally connected to a frame having a generally truncated right triangular prism shape. The table top is hinged to permit access to storage for drafting tools and papers within the frame and may be locked to prevent movement when the table is transported. The legs of the table pivot between vertical for use and horizontal for transporting, and are designed to overlap in the folded position in a compact arrangement. Each leg is independently height adjustable to permit the table to be made level on uneven surfaces, and wheels on each leg facilitate movement of the table in the open-for-use position. The table is constructed of durable materials to permit use out of doors or in adverse conditions.

10 Claims, 3 Drawing Sheets

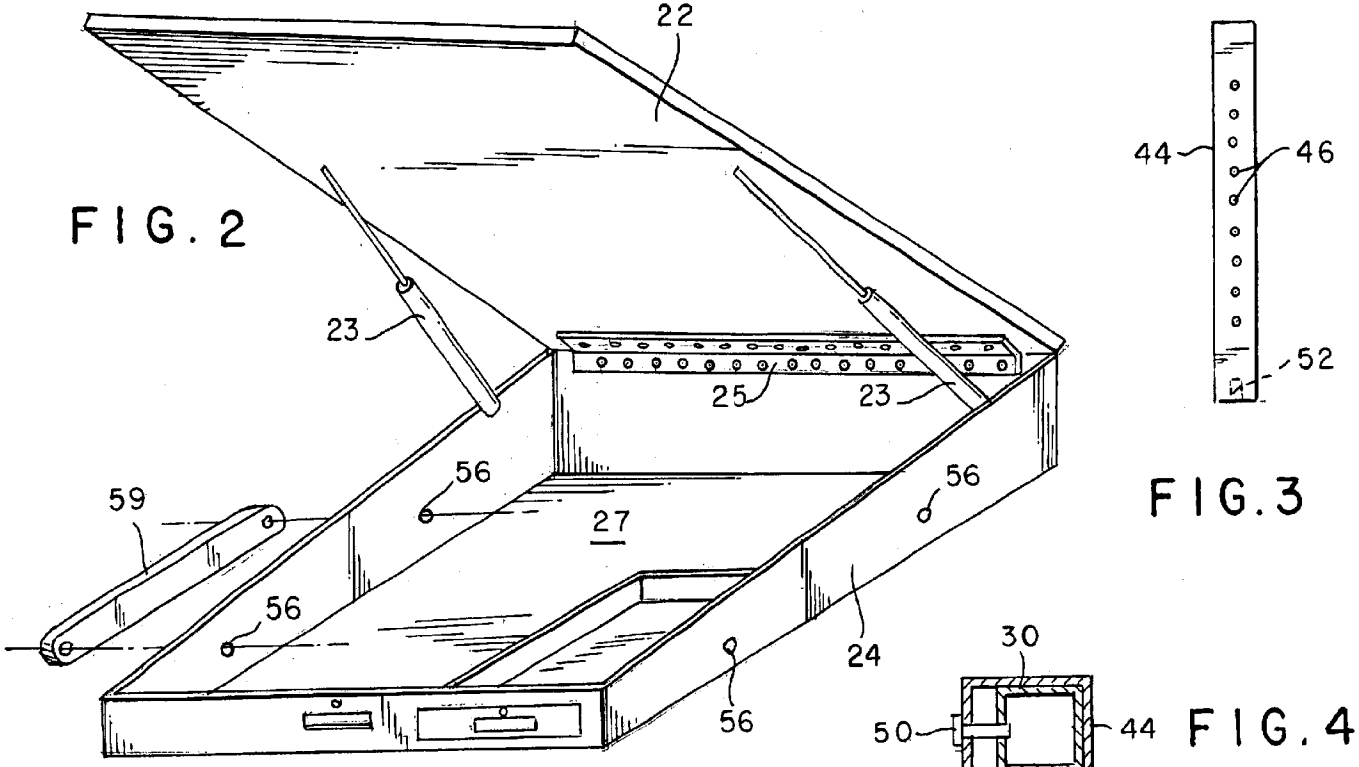
FIG. 2
FIG. 3
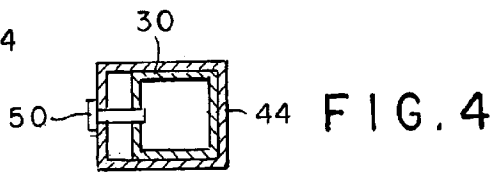
FIG. 4
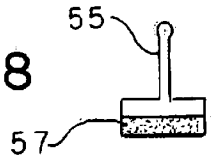
FIG. 8

FIG. 5
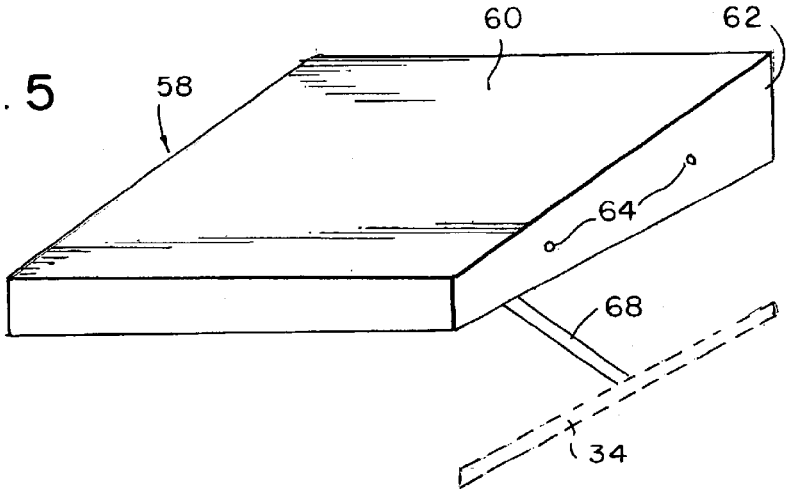
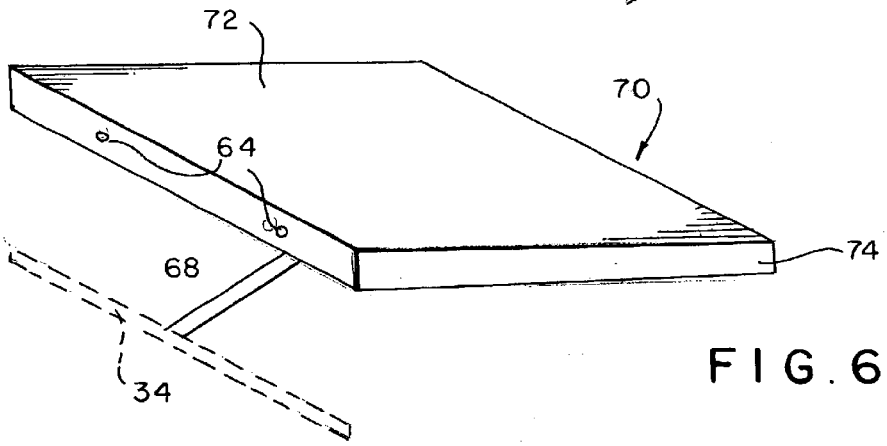
FIG. 6
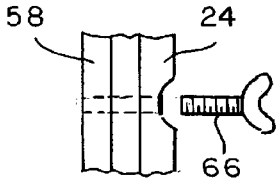
FIG. 7

PORTABLE EXPANDABLE PROJECT TABLE

BACKGROUND OF THE INVENTION

This invention relates to the field of portable tables, and more specifically to portable expandable project tables.

There are numerous applications requiring a versatile portable project table. For example, workers in the construction industry commonly require an on-site table to support blueprints, plans, specifications, technical drawings and other information. Routine working conditions demand a table that is suitable for outdoor use. These conditions include wind, rain, and other adverse weather conditions, uneven terrain, and frequent on-site relocation. Portability, including convenient vehicle transportability, is essential for tables. Despite the need for portability, project tables must be sturdy and adaptable to numerous applications. The ability to expand the table surface is also needed in many applications.

BRIEF DESCRIPTION OF THE PRIOR ART

Prior art drafting tables are unsuited for applications as described above in that they are commonly constructed exclusively for indoor use with limited mobility. As such, they have limited adjustability, are not constructed to withstand outdoor weather conditions, and are not readily transportable. Portable tables are commonly constructed to be lightweight rather than hardy. A folding portable drafting table representative of the prior art is described in U.S. Pat. No. 5,315,935 to Weisenfels. The table is constructed of light-weight wood, and will necessarily be unsuitable for use in typical outdoor conditions including wind or moisture. It is not height adjustable, nor can it be adjusted for uneven surface conditions. While portable, the basic table requires that three separate pieces be carried separately, it is not expandable, and it is not readily apparent that it can be moved without disassembly and reassembly. U.S. Pat. Nos. 4,372,631 to Leon and U.S Pat. No. 4,099,469 to Sahli also describe foldable drafting tables. Both tables are designed to fold only for ease of storage in a small space and they cannot be easily transported from one job site to another. The table described by Leon has wheels to facilitate movement only from room to room within a single building. Neither table is adjustable by height to accomodate various user requirements. Also, neither table is expandable or adjustable to accomodate any site condition other than a flat floor. U.S. Pat. No. 5,598,789 to Jonker describes a vertically adjustable table, the use of which would be limited to a relatively flat floor. It is not intended, and would not be suitable, for outdoor use or for convenient vehicle transportability.

Accordingly, there is a need for a portable drafting table that is suitable for on-site construction site use or use in other locations where hardiness is important. Such a table will be sturdy enough to withstand heavy use and adverse weather conditions. It will also be adjustable to accomodate sitting and standing users as well as uneven terrain. It will ideally have rollers for easy movement and will be expandable to accomodate unusually large drawings. Finally, it will fold compactly for easy carrying and transport by vehicle.

SUMMARY OF THE INVENTION

The present invention is a portable drafting table that folds compactly for convenient transport by vehicle, but is of sturdy construction to permit on-site construction project use. The legs of the table are independently adjustable to accommodate both the table surface height requirements of individual users and also level positioning on uneven terrain. The table top opens to expose a storage space within the frame. The frame also includes a storage drawer and a carrying handle for transportability.

BRIEF DESCRIPTION OF THE DRAWINGS

Other advantages of the invention will become apparent from a study of the following specification when viewed in light of the accompanying drawing, in which:

FIG. 2 is a perspective view of the table frame and table top in an open position;

FIG. 3 is an elevation view of an inner adjustable table leg;

FIG. 4 is a detailed top cutaway view of a table leg, illustrating a locking pin securing an outer fixed table leg and an inner adjustable table leg;

FIG. 5 is a front elevation view of an optional table extension;

FIG. 6 is a front elevation view of an optional plan holder;

FIG. 7 is a detailed illustration of a table extension securing mechanism; and FIG. 8 illustrates a snap-in shoe suitable for use with the invention.

DESCRIPTION OF THE PREFERRED EMBODIMENT

Figure 1:
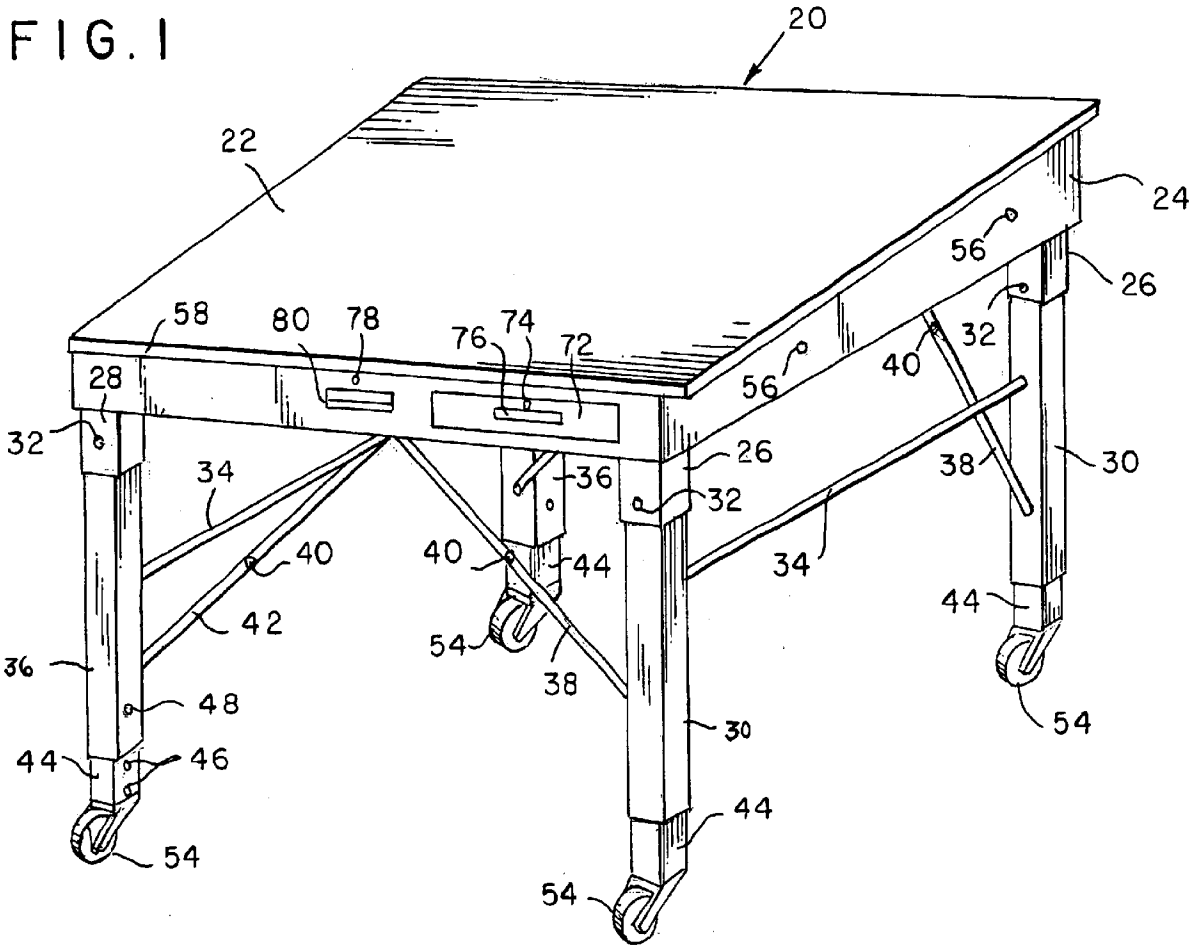
FIG. 1 is a perspective view of a preferred embodiment of the folding table.

Referring to FIGS. 1 and 2, a preferred embodiment of a portable expandable project plan table 20 according to the invention has a flat-surfaced table top 22 supported by a table frame 24. Table frame 24 has the general shape of a truncated right triangular prism having base, right and left side, front and back surfaces. Table top 22 is positioned atop the frame 24 to enclose the frame 24 when the table top 22 is in its closed position. Because frame 24 is deeper at the back than at the front, the table top 22 slopes downwardly from rear to front. The length and width of table top 22 is preferably somewhat greater than that of table frame 24 to create an overhang or lip to table top 22 along the front and both sides of frame 24. In a preferred embodiment, the lip is about 1 inch, but it may be varied at the discretion of the fabricator. The table, including the legs to be described below, is preferably made from a light-weight, but durable and strong, material such as aluminum. The aluminum-to-aluminum connections for the table legs and accessory attachments described herein is preferably welded.

Table top 22 is preferably secured to table frame 24 along the upper back edge of frame 24 by a piano hinge 25. Raising the front edge of table top 22 to its open position reveals a storage space 27 suitable for placing drawings, instruments or other items. Hydraulic arms 23 are affixed on each side to table top 22 and table frame 24 to hold table top 22 in a raised position and allow it to be controllably opened and closed without slamming. The hinge 25 is secured to the table top 22 and frame 24 by an aluminum weld. Alternatively, it may be secured by other devices such as rivets, bolts, or screws.

A leg bracket is rigidly fixed and extends downwardly at each corner from the base of table frame 24. In the preferred embodiment illustrated in FIG. 1, right side leg brackets 26 are relatively shorter than left side leg brackets 28 as will be explained more fully below. It will be readily apparent, however, that the invention will work equally well if the right side leg brackets 26 are relatively longer than left side leg brackets 28. Each table leg has an outer table leg segment and an inner table leg segment. Right side outer table leg segments 30 are pivotally secured to brackets 26 by a pivot pin such that table leg segments 30 may pivot in a 90 degree arc between vertical and horizontal underneath table frame 24. A fixed side leg brace 34 secures the right side outer table leg segments 30 together and provides fore-and-aft support to them. Left side leg brackets 28 are similar to right side leg brackets 26 except that brackets 28 are relatively shorter. Left side outer table leg segments 36 are pivotally secured to brackets 28 by a pivot pin 32 such that table leg segments 36 may pivot in a 90 degree arc between vertical and horizontal underneath table frame 24. A fixed side leg brace 34 secures the left side outer table leg segments 36 together and provides fore-and-aft support to them.

At both the front and rear of the table 20, a right side folding leg brace 38 is pivotally connected to table frame 24 and the table leg segment 30 to both permit the right table legs to fold under frame 24 and to restrict the table legs from rotating beyond the vertical away from the table. A pivot pin 40 at the center of folding leg brace 38 permits the table legs to fold under table frame 24. Any suitable device, a number of which are well-known in the prior art, may be used to lock the folding leg brace 38 in position when the table legs are extended for use. Similarly, at both the front and rear of the table 20, a left side folding leg brace 40 is pivotally connected to table frame 24 and the table leg segment 36 to both permit the left table legs to fold under frame 24 and to restrict the table legs from rotating beyond the vertical away from the table. A pivot pin 40 at the center of folding leg brace 42 permits the table legs to fold under table frame 24. It will be readily apparent to one skilled in the art that right folding leg brace 38 is longer than left folding leg brace 42 to accommodate the differences in length between right side leg bracket 26 and left side leg bracket 28.

The left side table legs 36 fold compactly under the right side table legs 30 in an overlapping, or nesting, arrangement, due to the relatively longer length of right side brackets 26 as compared to left side brackets 28. It will be readily apparent to one skilled in the art how to determine the precise lengths of the various components to obtain the desired compact arrangement.

Each of the outer table leg segments 30, 36 is adapted to receive an adjustable inner table leg segment 44 in telescoping arrangement. As is illustrated more clearly in FIGS. 1 and 3, each adjustable inner table leg segment 44 has a plurality of evenly spaced holes 46 on a first surface thereof. Each of the fixed outer table leg segments 30, 36 has a hole 48 of substantially identical diameter to holes 46 and positioned to successively align with each of the holes 46 as the adjustable inner table leg segment 44 is moved relative to the outer table leg segments 30, 36. A spring tension peg 50 mounted through hole 48 on each of the outer table leg segments 30, 36 engages hole 46 when holes 46 and 48 are aligned to lock inner table leg segment 44 in place, as is illustrated in FIG. 4. Inner table leg segment 44 has a socket 52 affixed at its lower end to receive the stem of a swivel "snap-in" non-marring caster wheel 54, as is well known in the prior art. The diameter and material of caster wheel 54 may be varied to maximize mobility on different surfaces such as finished or unfinished interior floors or uneven outside terrain. Alternatively, a snap-in aluminum shoe 55, as illustrated in FIG. 8, fitted with a rubber base 57 may be substituted for caster wheel 54 when it is desired that the table be more securely positioned in a fixed location.

As illustrated in FIG. 2, two non-threaded receivers 56 are placed on the right side of table frame 24 for mounting optional table extensions. Two additional non-threaded receivers are similarly mounted on the left side of table frame 24. A suitably sized aluminum spacer 59 is preferably inserted between frame 24 and a table extension. FIG. 5. illustrates a first optional table extension in the form of a table expansion 58. Table 58 has a top surface 60 and a frame 62 having a shape such that top surface 60 and table top 22 are coplanar when table expansion 58 is positioned adjacent frame 24. On one side of frame 62 are two threaded receivers 64 positioned to align with non-threaded receivers 56 when table expansion 58 is positioned adjacent table 20. FIG. 7 illustrates a preferred securing mechanism for securing table expansion 58 to table frame 24. A wing bolt 66 is passed through non-threaded receiver 56 of table frame 24 and threaded into the threaded receiver 64 of table expansion 58. A leg table brace 68 secured between the bottom of table expansion 58 and side leg brace 34 provides additional support for the table expansion 58.

FIG. 6 illustrates a second optional table extension in the form of a plan holder 70. Plan holder 70 has a horizontal top surface 72 and a frame 74. On one side of frame 74 are two threaded receivers 64 positioned to align with non-threaded receivers 56 when plan holder 70 is positioned alongside table 20. FIG. 7 illustrates a preferred securing mechanism for securing plan holder 70 to table frame 24. A wing bolt 66 is passed through non-threaded receiver 56 of table frame 24 and threaded into the threaded receiver 64 of plan holder 58. A leg table brace 68 secured between the bottom of plan holder 70 and side leg brace 34 provides additional support for the plan holder 70.

The versatility of the invention is substantially enhanced with the inclusion of a drawer 72 provided through the front surface of frame 24. A handle 76 permits opening and closing of the drawer 72, and a lock 74 permits drawer 72 to be locked for security and to prevent accidental opening when the table 20 is transported. Similarly, a lock 78 is provided to secure table top 22 to frame 24. Lock 78 both prevents access to the storage space 77 within frame 24 and also prevents accidentally opening of table top 22 when the table 20 is being transported.

Locks 74 and 78 are preferably keyed, lockable cam locks. Alternatively, a non-locking clasp of which there are many suitable types well-known in the prior art may be substituted in place of locks 74 and 78 if physical security is not considered necessary or desirable. A handle 80 is secured near the mid-section of the front surface of frame 24 to facilitate transportability of the table 20 when it is folded.

While the preferred forms and embodiments of the invention have been illustrated and described, it will be apparent to those of ordinary skill in the art that various changes and modification may be made without deviating from the inventive concepts set forth above.

What is claimed is:

1. A portable, expandable project plan table, comprising:

(a) a frame having a generally rectangular base, right and left sides, a front and a back;

(b) a table top rotatably secured to the frame along the back opposite the base and having an opened position and a closed position, wherein the table top covers the frame in a closed position and permits access to the interior of the frame for storage when in the opened position;

(c) a fastening device for securing the table top in the closed position; and (d) a plurality of legs, one leg pivotally connected with each corner of the base opposite the table top, each leg being further connected with a remote portion of the base by a pivot brace such that the legs may be moved between a vertical position and a horizontal position under the base, said pivot brace stabilizing each leg and preventing its movement beyond the vertical position, the legs on the right side of the base being rigidly connected by a brace so they pivot together and the legs on the left side of the base being rigidly connected by a brace so they pivot together, the pivot point for the legs on the right side being at a first distance below the base and the pivot point for the legs on the left side of the base being at a second distance below the base, the first and second distances being different, wherein the legs fold under the base in an overlapping relationship without extending beyond the base; each leg further including an outer leg segment and an inner leg segment, the inner leg segment being movably disposed within the outer leg segment to permit relative movement of the segments for independent adjustment of the length of each leg.

2. A table as defined in claim 1, and further comprising a plurality of hydraulic arms connecting the frame and the table top for holding the table in the opened position.

3. A table as defined in claim 2, and further comprising a table extension abutting a side of the frame and detachably connected thereto, the top of the extension being substantially coplanar with the table top.

4. A table as defined in claim 3, and further comprising a handle affixed near the midpoint of the front of the frame.

5. A table as defined in claim 2, and further comprising a table extension abutting a side of the frame and detachably connected thereto, the top of the extension being substantially horizontal.

6. A table as defined in claim 2, and further comprising a drawer positioned on the front of the frame and extending into the frame.

7. A table as defined in claim 6, and further comprising means for securing the drawer in a closed position within the frame.

8. A table as defined in claim 7, wherein the means for securing the drawer is a keyed lockable cam lock.

9. A table as defined in claim 1, wherein the table top fastening device is a keyed lockable cam lock.

10. A portable, expandable project plan table, comprising:

(a) a frame having a generally rectangular base, right and left sides, a front and a back, with the back being at a higher elevation than the front;

(b) a table top rotatably secured to the frame along the back opposite the base and having an opened position and a closed position, wherein the table top covers the frame in a closed position and permits access to the interior of the frame for storage in when in the opened position;

(c) a plurality of legs, one leg pivotally connected with each corner of the base opposite the table top, each leg being further connected with a remote portion of the base by a pivot brace such that the legs may be moved between a vertical position and a horizontal position under the base, said pivot brace stabilizing each leg and preventing its movement beyond the vertical position, the legs on the right side of the base being rigidly connected by a brace so they pivot together and the legs on the left side of the base being rigidly connected by a brace so they pivot together, the pivot point for the legs on the right side being at a first distance below the base and the pivot point for the legs on the left side of the base being at a second distance below the base, the first and second distances being different, wherein the legs fold under the base in an overlapping relationship without extending beyond the base; each leg further including an outer leg segment and an inner leg segment, the inner leg segment being movably disposed within the outer leg segment to permit relative movement of the segments for independent adjustment of the length of each leg;

(d) a plurality of hydraulic arms connecting the frame and the table top for holding the table tap in the opened position;

(e) a drawer positioned on the front of the frame and extending into the frame;

(f) means for securing the front of the table top to the frame when the table top is in the closed position;

(g) means for securing the drawer in a closed position within the frame; and (h) a handle affixed near the midpoint of the front of the frame.

* * * * *